US005769766A

United States Patent [19]

Huang

[11] Patent Number: 5,769,766

[45] Date of Patent: Jun. 23, 1998

[54] EXERCISE MACHINE FOR BUILDING ABDOMEN AND LEGS

[76] Inventor: Chin-Lien Huang, 2F, No. 14, Ning Hsia E. 5 St., Taichung, Taiwan

[21] Appl. No.: 778,365

[22] Filed: Jan. 2, 1997

[51] Int. Cl.[6] ..... A63B 23/02

[52] U.S. Cl. ..... 482/140; 482/95; 482/123; 482/133; 482/142

[58] Field of Search ..... 482/72, 92, 95, 482/96, 121–123, 129–140, 142, 148, 908; 297/68, 75, 90, 91; 601/23, 24, 26

[56] References Cited

U.S. PATENT DOCUMENTS

| | | | |
|---|---|---|---|
| 5,346,447 | 9/1994 | Stearns | 482/142 |
| 5,531,658 | 7/1996 | L.S.C. | 482/142 |
| 5,545,114 | 8/1996 | Gvoich | 482/142 |
| 5,601,519 | 2/1997 | Comereski | 482/142 |
| 5,665,041 | 9/1997 | Hsieh | 482/140 |
| 5,676,626 | 10/1997 | Huang | 482/95 |

*Primary Examiner*—Jeanne M. Clark
*Attorney, Agent, or Firm*—Browdy and Neimark

[57] ABSTRACT

An exercise machine comprises a base, a abdomen-building mechanism and a leg-building mechanism. The abdomen-building mechanism is fastened pivotally with a slide rail frame of the base and is provided with two pull arms and a backrest pad capable of moving in relation to the slide rail frame. The leg-building mechanism is fastened pivotally with a main support rod and is provided with a first leg rod, a second leg rod, and a plurality of connection rods for connecting the leg-building mechanism with the abdomen-building mechanism. As abdomen-building mechanism is rotated upwards by the traction force of the hips and the abdomen of an exerciser, the leg-building mechanism is actuated to provided the exerciser with the leg-building exercise. The neck and the back of the exerciser are well supported by the bulged portion of the backrest pad of the abdomen-building mechanism when the exerciser is engaged in the exercise.

4 Claims, 3 Drawing Sheets

EXERCISE MACHINE FOR BUILDING ABDOMEN AND LEGS

FIELD OF THE INVENTION

The present invention relates generally to an exercise machine, and more particularly to an exercise machine intended for use in developing abdomen and legs of a person.

BACKGROUND OF THE INVENTION

The multipurpose exercise machines currently available in the market today are generally defective in design in that they are cumbersomely complicated in construction, and that they are rather expensive, and further that they are devoid of means for supporting the back and the neck of a person using the exercise machines. It is conceivable that the back and the neck of the person using the exercise machines are rather vulnerable to injuries if the back and the neck are not supported appropriately.

SUMMARY OF THE INVENTION

It is therefore the primary objective of the present invention to provide an exercise machine with means for supporting the back and the neck of a person using the exercise machine for building his or her abdomen and legs.

It is another objective of the present invention to provide an exercise machine which is intended to build the abdomen and the legs of a person and is simple in construction.

In keeping with the principle of the present invention, the foregoing objectives of the present invention are attained by an exercise machine designed for use in building the abdomen and the legs of an exerciser. The exercise machine comprises a base, an abdomen-building mechanism, and a leg-building mechanism. The abdomen-building mechanism is fastened pivotally with a slide rail frame of the base and is provided with two pull arms and a backrest pad slidable in relation to the slide rail frame. The leg-building mechanism is fastened pivotally with a main support rod and is provided with a first leg rod, a second leg rod, and a plurality of connection rods for connecting the leg-building mechanism with the abdomen-building mechanism. As the abdomen-building mechanism is rotated upwards by the traction force of the hips and the abdomen, the leg-building mechanism is actuated. In the meantime, the neck and the back of a person using the exercise machine are well supported when the person is doing the abdomen-building exercise and the leg-building exercise.

The foregoing objectives, features and functions of the present invention will be more readily understood upon a thoughtful deliberation of the following detailed description of an embodiment of the present invention in conjunction with the accompanying drawings.

DETAILED DESCRIPTION OF THE INVENTION

Figure 1:
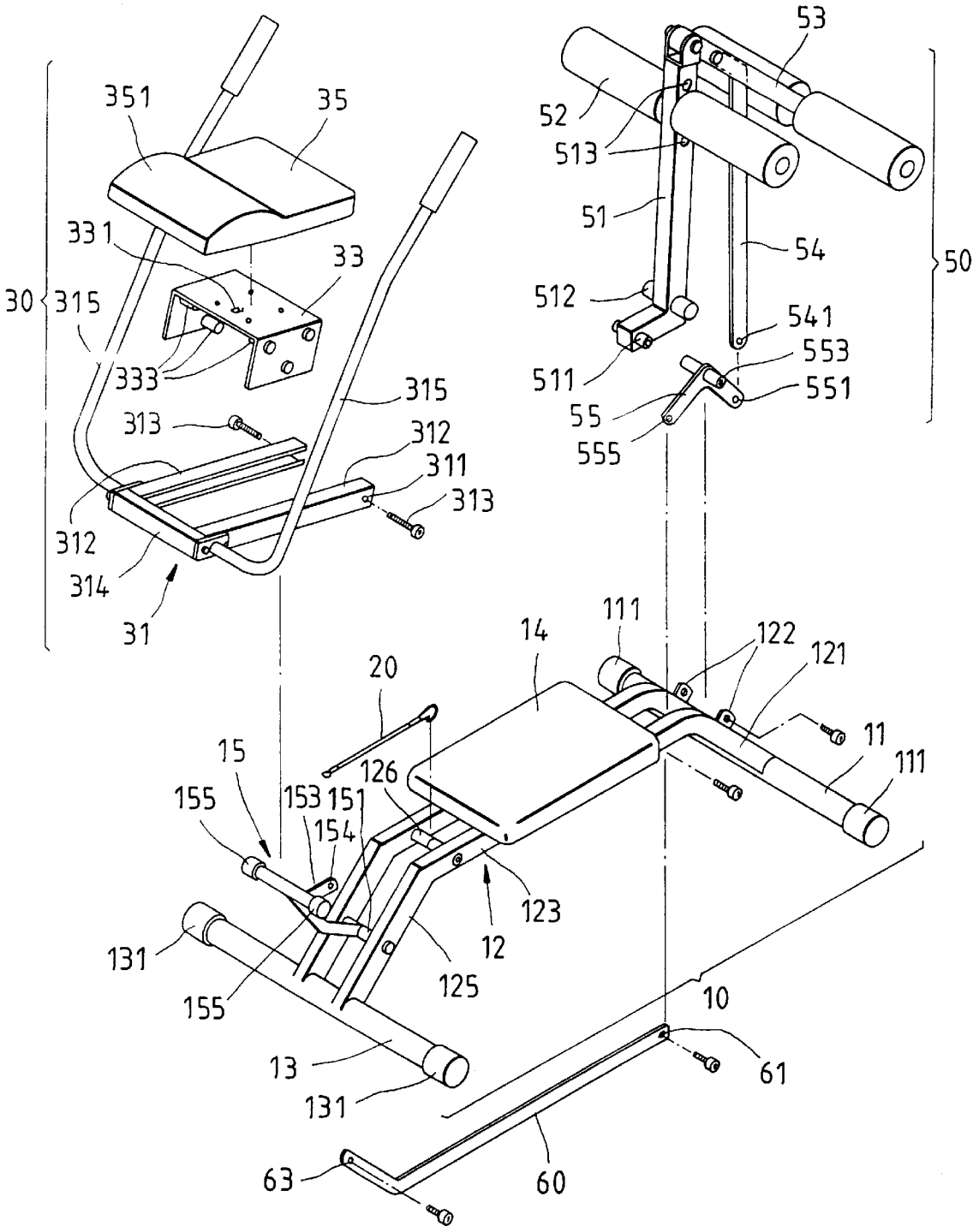
FIG. 1 shows an exploded view of the embodiment of the present invention.
Figure 2:
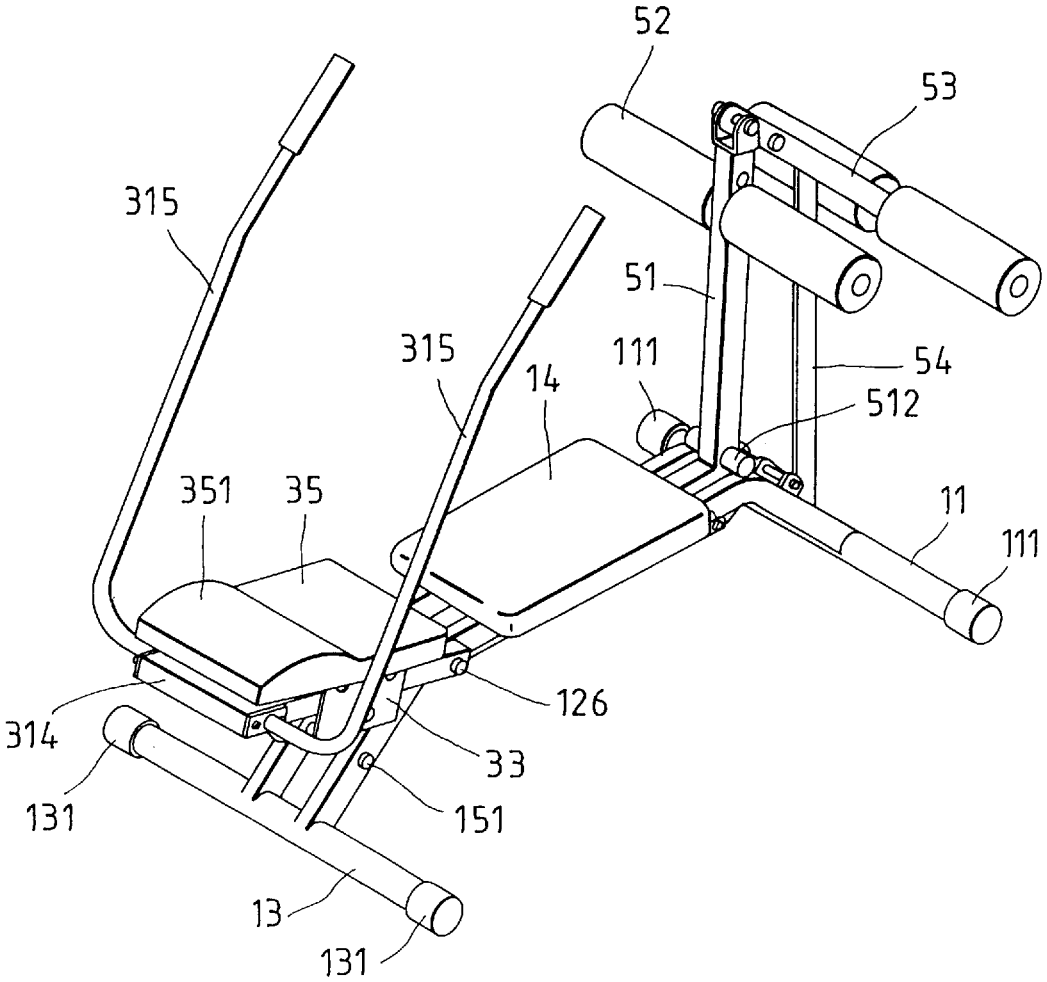
FIG. 2 shows a perspective view of the present invention in combination.

As shown in FIGS. 1 and 2, an exercise machine embodied in the present invention is composed of a base 10, an abdomen-building mechanism 30, and a leg-building mechanism 50.

The base 10 is located on the surface of a floor and is composed of a front cross rod 11, a rear cross rod 13, and two parallel support rods 12 located between the front cross rod 11 and the rear cross rod 13. The front cross rod 11 is provided respectively at both ends thereof with a skidproof plastic pad 111 fastened therewith, whereas the rear cross rod 13 is provided respectively at both ends thereof with a skidproof plastic pad 131 fastened therewith. The support rod 12 has a front inclined segment 121, a horizontal segment 123 and a rear inclined segment 125. The front inclined segment 121 is provided with two lugs 122. The horizontal segment 123 is provided with a through hole 124. A seat 14 is secured to the support rods 12. A pivot 126 is fastened between the support rods 12 such that the pivot 126 is contiguous to the seat 14. A T-shaped connection rod 15 is fastened at one end thereof by welding with a shaft 151 and is further fastened pivotally with the rear inclined segment 125 of the support rod 12. The connection rod 15 is provided respectively at both ends of the top thereof with a rolling member 155 and is further provided with an extension rod 153 having a through hole 154.

The abdomen-building mechanism 30 comprises a slide rail frame 31 having two parallel slide bars 312 fastened respectively at one end thereof with a cross rod 314. The slide bars 312 is provided respectively at another end thereof with a through hole 311. A U-shaped pull arm 315 is fastened with the slide bars 312. A slide seat 33 is U-shaped in its cross section and is provided with a backrest pad 35 fastened therewith. The backrest pad 35 has a bulged portion 351. The slide seat 33 is provided at the center of the top thereof with a hooking hole 331 and is further provided with a plurality of rolling members 333 arranged in a triangular configuration such that two slide bars 312 are located between the upper row of two rolling members and the lower rolling member. The abdomen-building mechanism 30 is fastened with the base 10 by two fastening bolts 313 engageable with the through holes 311 of the slide bars 312 and the pivot 126. An elastic strip 20 has one end which is engaged with the hooking hole 331 of the slide seat 33. The elastic strip 20 further has another end which is fastened with the pivot 126 of the base 10.

The leg-building mechanism 50 comprises a main support rod 51 of an L-shaped construction and provided with a tube 511 which is fastened pivotally with the through hole 124 of the horizontal segment 123 of the base 10. The main support rod 51 is provided with a position restricting member 512 pressing against the horizontal segment 123 of the base 10 for supporting the leg-building mechanism 50. The main support rod 51 is further provided with a plurality of locating holes 513 for mounting adjustably a first leg rod 52. A T-shaped second leg rod 53 is fastened pivotally with the main support rod 51 which is provided with a groove (not shown in the drawings) for pivoting a first connection rod 54. An L-shaped arm 55 has a center 553 which is fastened pivotally with the lugs 122 of the front inclined segment 121 of the base 10. The L-shaped arm 55 has a through hole 551. The arm 55 has one end 555 which is fastened pivotally with one end 61 of a second connection rod 60. The second connection rod 60 is fastened pivotally at another end 63 thereof with the cross rod 153 of the connection rod 15.

Figure 3:
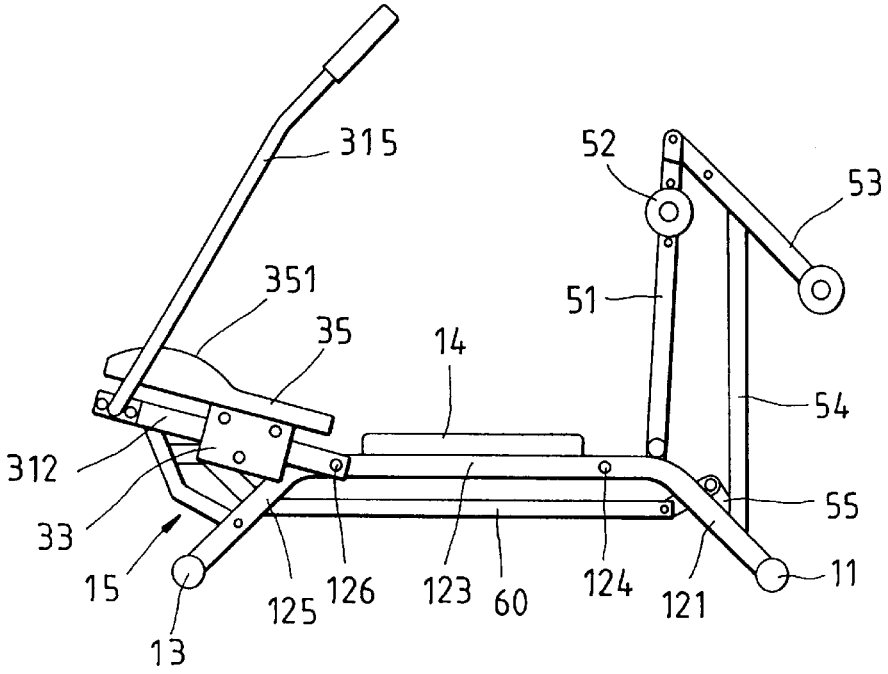
FIG. 3 shows a side view of the embodiment of the present invention.
Figure 4:
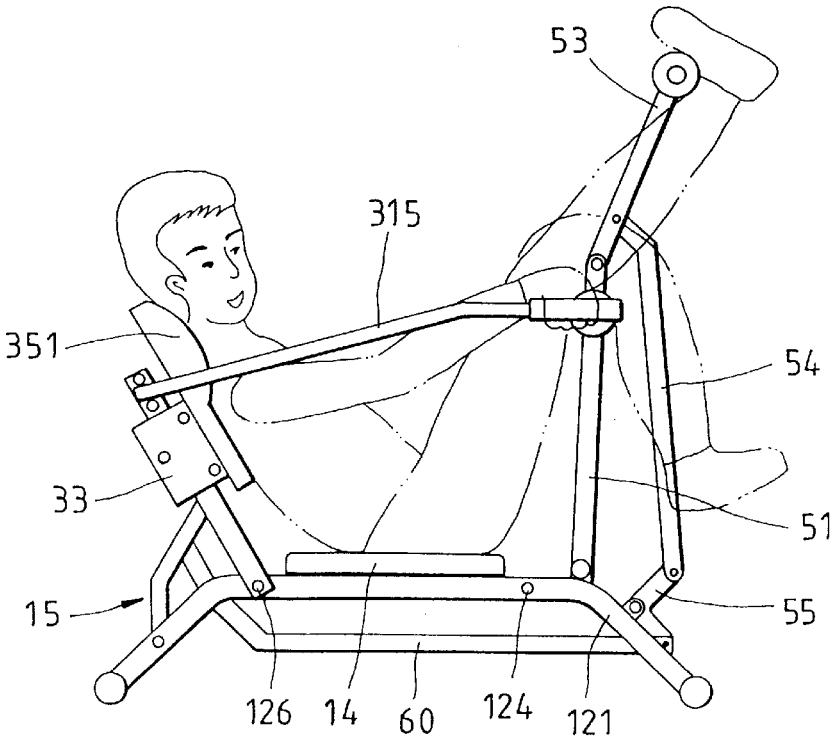
FIG. 4 shows a schematic view illustrating the present invention at work.

As illustrated in FIGS. 3 and 4, the first connection rod 54 is received in the groove of the second leg rod 53 to keep the second leg rod 53 in an inclined position before the exercise machine of the present invention is at work. An exerciser is seated on the seat 14 such that the neck of the exerciser is supported by the bulged portion 351 of the backrest pad 35, and that the hips of the exerciser are supported by the seat 14, and further that the leg hamstrings of the exerciser are supported by the first leg rod 52, and still further that both hands of the exerciser hold securely the pull arm 315. The abdomen-building mechanism 30 can be now caused by the traction force of the hands and the abdomen of the exerciser to rotate on the pivot 126 of the horizontal segment 123 of the base 10. As a result, the abdomen-building mechanism 30 is raised so as to cause the upper trunk of the exerciser to move upwards. In the meantime, the second connection rod 60, the arm 55 and the first connection rod 54 are so actuated that the second leg rod 53 is raised. As the abdomen-building mechanism 30 is relieved of the traction force, the abdomen-building mechanism 30 is caused to return to remain in its original state. The actions described above are repeated to bring about the exercise effect of building the abdomen muscles as well as the leg muscles.

The exercise machine of the present invention is unique in design in that the backrest pad 35 is capable of motion in relation to the parallel slide bars 312 so as to give an effective support to the back of an exerciser, and that the backrest pad 35 is provided with the traction force by the elastic strip 20 so as to enable the bulged portion 351 of the backrest pad 35 to make an intimate contact with the neck of the exerciser to minimize the vulnerability of the neck to injuries, and further that the disposition of the pull arm 315 can avert the injury of cervical vertebrae of the exerciser, and still further that the present invention allows an exerciser to do the abdomen exercise and the leg exercise by means of the abdomen-building mechanism 30 and the leg-building mechanism 50.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An exercise machine comprising:

a base having a front inclined segment, a rear inclined segment, and a horizontal segment which is provided thereon with a seat fastened therewith, said rear inclined segment provided with a connection rod having two rolling members fastened pivotally with one end of said connection rod;

a abdomen-building mechanism comprising a slide rail frame having two parallel slide bars and two pull arms, said slide rail frame fastened pivotally with said horizontal segment of said base and provided with a slide seat having a backrest pad mounted thereon, said slide seat capable of moving in relation to said slide rail frame; and a leg-building mechanism comprising a main support rod fastened pivotally with said horizontal segment of said base, said leg-building mechanism further comprising a first leg rod, a second leg rod, a first connection rod and a second connection rod, with said first leg rod being mounted on said main support rod, with said second leg rod being fastened pivotally at one end thereof with said main support rod, with said first connection rod being fastened pivotally at one end thereof with said second leg rod such that another end of said first connection rod is fastened pivotally with one end of an L-shaped arm which is in turn fastened pivotally at one end thereof with said front inclined segment of said base and is further fastened pivotally at another end thereof with one end of said second connection rod, said second connection rod being fastened pivotally at another end thereof with said connection rod of said rear inclined segment of said base.

2. The exercise machine as defined in claim 1, wherein said base and said slide seat of said abdomen-building mechanism are provided therebetween with an elastic strip.

3. The exercise machine as defined in claim 1, wherein said backrest pad has a bulged portion.

4. The exercise machine as defined in claim 1, wherein said main support rod is provided with a plurality of through holes for adjusting the position of said first leg rod.

* * * * *